US009968813B2

(12) United States Patent
Bliznets et al.

(10) Patent No.: US 9,968,813 B2
(45) Date of Patent: May 15, 2018

(54) AUTONOMOUS FIRE-FIGHTING AGENT

(75) Inventors: Igor Bliznets, Moscow (RU); Victor Seregin, Moskovkaya (RU)

(73) Assignee: PiroChimica-Center, Moscow (RU)

( * ) Notice: Subject to any disclaimer, the term of this patent is extended or adjusted under 35 U.S.C. 154(b) by 649 days.

(21) Appl. No.: 13/984,557

(22) PCT Filed: Feb. 9, 2012

(86) PCT No.: PCT/IB2012/000221
§ 371 (c)(1),
(2), (4) Date: Aug. 9, 2013

(87) PCT Pub. No.: WO2012/107825
PCT Pub. Date: Aug. 16, 2012

(65) Prior Publication Data

US 2013/0313466 A1 Nov. 28, 2013

(30) Foreign Application Priority Data

Feb. 10, 2011 (RU) ..... 2011104729

(51) Int. Cl.
*A62D 1/00* (2006.01)
*A62D 1/06* (2006.01)

(52) U.S. Cl.
CPC ..... *A62D 1/0021* (2013.01); *A62D 1/0092* (2013.01); *A62D 1/06* (2013.01)

(58) Field of Classification Search
None
See application file for complete search history.

(56) References Cited

U.S. PATENT DOCUMENTS 3,707,385 A * 12/1972 Seidl et al. ..... A62D 1/00 106/18.11
4,230,808 A * 10/1980 Pietersen ..... A62D 1/0021 116/101
4,867,902 A * 9/1989 Russell ..... A62D 9/00 252/186.27
6,159,878 A * 12/2000 Marsh ..... A62B 17/003 156/67

FOREIGN PATENT DOCUMENTS

| | | | | |
|---|---|---|---|---|
| CN | 101298509 | | * | 11/2008 |
| JP | 2007160028 | A | | 6/2007 |
| JP | 2009119240 | A | | 6/2009 |
| RU | 2161520 | C1 | | 1/2001 |
| RU | 90994 | U1 | | 1/2010 |
| RU | 2403934 | C1 | * | 11/2010 |
| WO | 1999/056830 | A1 | | 11/1999 |
| WO | WO 9956830 | | * | 11/1999 |

* cited by examiner

*Primary Examiner* — Tanisha Diggs
(74) *Attorney, Agent, or Firm* — McGlew and Tuttle, P.C.

(57) ABSTRACT

An autonomous fire-fighting agent (10) formed from a material with fire-extinguishing properties. The material includes: microcapsules with a fire-extinguishing composition, the microcapsules having sizes of from 2 to 100 μm and being in the form of a halocarbon enclosed in a polymeric shell consisting of polyurea and/or polyurethane; and a binder. The binder includes a composite material having a polymeric component and mineral fibers and/or particles. The invention also relates to a method for manufacturing an autonomous fire-fighting agent (10) and an object which uses the autonomous fire-fighting agent (10) to fight a fire 10-20 s after ignition.

16 Claims, 3 Drawing Sheets

AUTONOMOUS FIRE-FIGHTING AGENT

CROSS REFERENCE TO RELATED APPLICATIONS

This application is a U.S. National Phase Application of International Application PCT/IB2012/000221 filed Feb. 9, 2012 and claims the benefit of priority under 35 U.S.C. § 119 of Russian patent application RU 2011104729 filed Feb. 10, 2011, the entire contents of which are incorporated herein by reference.

FIELD OF THE INVENTION

The invention firefighting agents, in particular, to autonomous firefighting agents and may be used to put out fire at the early stages thereof.

More specifically, in one embodiment of the invention, it relates to an autonomous firefighting agent.

BACKGROUND OF THE INVENTION

A prior art firefighting agent is made from a material having fire-extinguishing properties and consists of microcapsules of fire-extinguishing composition embedded in a polymeric binder. The microcapsules are microspheres consisting of spherical gelatin shells, each enclosing a liquid firefighting agent such as any substances in the class of halo-organic compounds of the formula $C_3F_7I$, or $C_nF_{2n+2}$, or $(C_2F_5)_2N(C_mF_{2m+1})$, wherein n=5-7 and m=1-2, that are released automatically upon heating. The microcapsules have a size of 100 to 400 μm (that is, from $10^{-4}$ m to $4\cdot10^{-4}$ m) and open up within the temperature range of 130 to 149° C. and 166 to 190° C. (Patent RU2161520, 1998).

The prior art agent is deficient because making gelatin shells for microcapsules used therein to micro-capsulize a fire-extinguishing composition is a technologically complicated and expensive process that raises significantly the costs of products manufactured from this material. Besides, the prior art agent has a very high triggering threshold (at a temperature of 130° C.) that is not always acceptable.

The closest related prior art invention of the claimed agent is an autonomous firefighting agent made from a material having fire-extinguishing properties that comprises microcapsules containing a fire-extinguishing composition, said microcapsules having a size ranging from 2 to 100 μm (that is, from $2\cdot10^{-6}$ m to $10^{-5}$ m), said material being halocarbon enclosed in a polymeric shell of polyurea and/or polyurethane, and a binder such as a polymeric resin. The prior art agent has a mass content of halocarbon varying between 70% and 90%. The material having fire-extinguishing properties is applied to a solid-phase support, for example, a metal substrate (Patent RU90994, 2009).

The prior art agent has capsules opening within the temperature range of 110 to 165° C. and is manufactured in an advanced process at lower costs.

The prior art agent, though, has a number of drawbacks. For example, the fire-fighting layer may crack and flake off the substrate surface over time and/or with fluctuations in the temperature and moisture content of the environment. As a result, the fire-extinguishing properties of the agent deteriorate and it may fail to function in response to ignition. Furthermore, for the substrate material, for example, metal, coated with the fire-extinguishing composition to adhere firmly to the walls of an object protected, the surface to which the agent is attached must meet certain requirements, such as be smooth and level, a requirement that is not always attainable in practice. It has also been demonstrated practically that a material having fire-extinguishing properties exhibits its best properties when the content of halocarbon therein is other than in the range of 70% to 90%.

SUMMARY OF THE INVENTION

It is an object of the present patent application to develop an autonomous firefighting agent made from a composite material having fire-extinguishing properties on the basis of a micro-capsulized fire-extinguishing composition that is durable, strong, and flexible to be suitable for practical employment without using a solid-phase substrate.

The technical effect of this invention is achieved in an autonomous firefighting agent made from a material having fire-extinguishing properties and containing microcapsules filled with a fire-extinguishing composition and having a size ranging from 2 to 100 m (that is, $2\cdot10^{-6}$ m to $10^{-5}$ m), said microcapsules being halocarbon enclosed in a polymeric shell of polyurea and/or polyurethane, and a binder, said binder being a composite material comprising a polymeric component and mineral fibers and/or particles, said halocarbon being enclosed in a polymeric shell of polyurea and/or polyurethane on the basis of a polyisocyanate prepolymer, and said halocarbon being 1,1,2,2-tetrafluorodibromoethane, and/or 1,1,2-trifluorotrichloro ethane, and/or 2-iodo-1,1,1,2,3,3,3-heptafluoropropane, and/or a mixture thereof with other halocarbons.

The other halocarbons in the mixture preferably contain any one of the following second substances: (a) 1,1,2,2-tetrafluoroethane; (b) 1,1-difluoro-2,2,2-trichloroethane; (c) 1,2-difluorotrichloroethane; (d) 1,1-difluoro-1,2-dichloroethane; (e) 1,2-difluoro-1,1-dichloroethane; (f) 1,1-difluoro-1-chloroethane; (g) 1-fluoro-1,1-dichloroethane; (h) 1-fluoro-2-chloroethane; (i) pentafluorochloroethane; (j) 1,1,2,2-tetrafluorodichloroethane; (k) 1,1,1-trifluorotrichloroethane; (l) 1,1,2-trifluorotrichloroethane; (m) 1,1-difluorotetrachloroethane; and (n) 1,2-difluorotetrachloroethane.

Preferably, the mineral fibers contain at least one of the following materials: (a) glass fiber; (b) basalt fiber; (c) fiber of natural minerals; and (d) fiber of artificial minerals.

Preferably, the mineral particles contain at least one of the following materials: (a) calcite; (b) marble; (c) chalk; (d) natural minerals; and (e) artificial minerals.

Preferably, the polymeric component contains at least one of the following substances: (a) acrylic resin; (b) alkyd resin; (c) glyptal resin; (d) latex resin; (e) pentaphthalic resin; (f) epoxy resin; (g) polyurethane; (h) polyurea; (i) polyvinyl alcohol; and (j) polyvinyl acetate.

The agent may preferably be manufactured in the form of a plate.

Microcapsules made from polyurea or polyurethane on the basis of a polyisocyanate prepolymer have a high strength to be filled with halocarbons and also have a thin shell exploding at a specified temperature in the range of 110 to 165° C. The shell remains tightly sealed for a long time for the fire-extinguishing agent to be stored for several years at an efficiency loss of 10% at most.

Polyisocyanate prepolymer used in this invention is essential for producing a "denser" cellular polyurea polymer having stronger chemical bonds and/or polyurethane because polyisocyanate reacts with several thousand hydroxyl or amino groups.

The binder, which is a composite polymeric material containing a polymeric component and mineral fibers and/or particles, contributes strength, flexibility, and durability to the agent.

The properties of the polymeric component are beneficial for manufacturing the agent in which microcapsules and other components of the composite material are distributed in the resin, whereupon the resulting fluid mass is shaped and solidifies into the claimed firefighting agent.

The mineral component helps capsules to be distributed evenly in the filler during the agent manufacturing process such that the filler does not crush the capsules upon drying. Mineral fibers prevent the resulting material from cracking, and mineral particles cause air pores to be formed in the material for all the capsules in the material to function upon ignition such that all gas enclosed in the capsules, rather than a portion thereof, is used to put out the fire.

The geometrical plate-like shape of the agent contributes to its maximum efficiency in use. Apart from plate shape, the agent may have any other shape suitable for protecting a particular object.

According to its second embodiment, the invention relates to a method for manufacturing an autonomous firefighting agent according to the claimed invention. The method comprises the manufacturing steps of:

- preparing a first mixture of a fire-extinguishing agent and polyisocyanate;
- obtaining an emulsion of the first mixture in an aqueous solution of polyvinyl alcohol;
- adding the resulting emulsion to an aqueous solution of polyethylene polyamine;
- producing a suspension of microcapsules in water;
- preparing a second mixture of the suspension and a binder;
- shaping plates from the second mixture;
- drying the plates;
- applying an adhesive layer to one side of a plate;
- covering the adhesive layer with a detachable protective film; and
- cutting pieces of a specified size out of the plates.

This manufacturing method helps obtain a highly effective firefighting agent that releases the fire-extinguishing agent intensively and is flexible, strong, durable, reliable, and lightweight in use.

According to its third embodiment, the invention relates to an object using the autonomous firefighting agent of this invention to put out fire within 10 to 20 seconds after ignition.

The invention helps effectively to protect objects such as, for example, electrical switchboards and boxes (in particular, electrical socket boxes), engine bays of vehicles, transformer stations, server stations, and other electrical switchgear and power units against destruction by fire.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
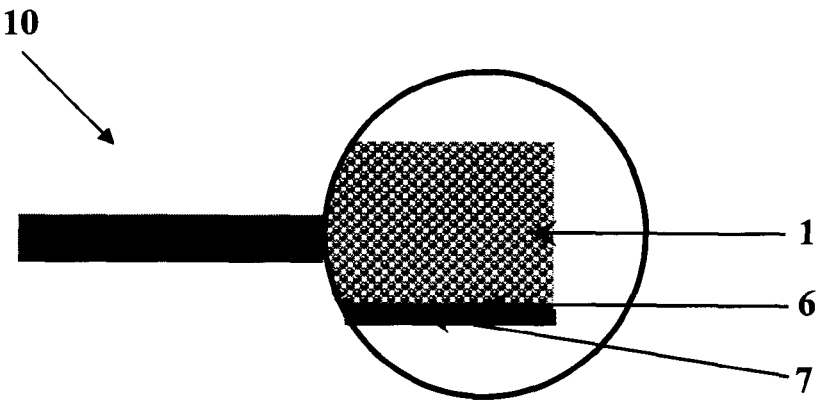
FIG. 1 is a diagrammatic general side view of the autonomous firefighting agent.
Figure 2:
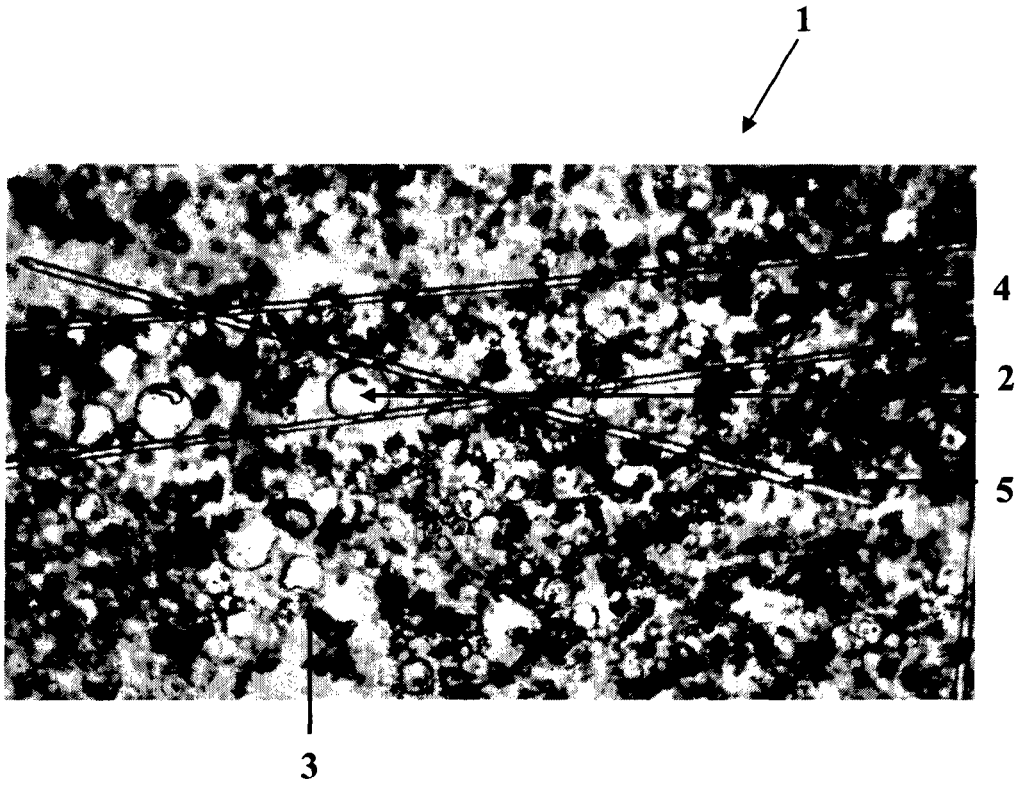
FIG. 2 is a microphotographic view of the structure of a composite fire-extinguishing material.

In its first embodiment, the invention relates to an autonomous firefighting agent 10 cut out of a sheet 1 of a composite material having fire-extinguishing properties. The material comprises microcapsules 2 of a fire-extinguishing composition having a size of 2 to 100 μm (that is, from $2 \cdot 10^{-6}$ m to $10^{-5}$ m) selected from halocarbons, such as 1,1,2,2tetrafluorodibromoethane, and/or 1,1,2-trifluorotrichloroethane, and/or 2-iodo-1,1,1,2,3,3,3-heptafluoropropane, and/or a mixture thereof with other halocarbons, enclosed in a polymeric shell of polyurea, and/or polyurethane on the basis of a polyisocyanate prepolymer.

The aforesaid halocarbons may be used in a mixture with the following halocarbons: 1,1,2,2-tetrafluoroethane; 1,1-difluoro-2,2,2-trichloroethane; 1,2-difluorotrichloroethane; 1,1-difluoro-1,2-dicloroethane; 1,2-difluoro-1,1-dichloroethane; 1,-difluoro-1-chloroethane; 1 fluoro-1,1-dichloroethane; 1-fluoro-2-chloroethane; pentafluorochloroethane; 1,1,2,2-tetrafluorodichloroethane; 1,1,1-trifluorotrichloroethane; 1,1,2-trifluorotrichloroethane; 1,1-difluorotetrachloroethane; 1,2-difluorotetrachloroethane; and so on.

Microcapsules 2 are distributed in a binder 3, which is a composite polymeric material comprising a polymeric component and a mineral component 4 in the form of fibers 5 and/or particles. Natural and artificial minerals may be used as mineral component 4 in the binder. Glass fiber, basalt fiber, and other fibers may be used as mineral fibers 5. Calcite, marble, chalk, and other particles may be used as mineral particles.

The polymeric component may be chosen from acrylic, and/or alkyd, and/or glyptal, and/or latex, and/or pentaphthalic, and/or epoxy resins, and/or polyurethane, and/or polyurea, and/or polyvinyl alcohol, and/or polyvinyl acetate.

An adhesive layer 6 covered with a protective film 7 (FIG. 1) is applied to one side of the formed composite material 1 to attach the same to the surface of an object to be protected.

According to its second embodiment, the invention relates to a method for manufacturing (100) an autonomous firefighting agent 10.

Microcapsulized halocarbons are obtained by polymerization on the interface of the phases. For this purpose, a first mixture of a fire-extinguishing agent and polyisocyanate is prepared (101). The resulting first mixture is poured into an aqueous solution of polyvinyl alcohol to obtain (102) an emulsion. An aqueous solution of polyethylene polyamine is added (1020) to the emulsion to obtain (103) a suspension to form the shells of microcapsules 2. The suspension of microcapsules 2 and the fire-extinguishing agent is mixed with binder 3 to obtain (104) a second mixture.

The resulting second mixture mass is placed (1040) in a pan designed for this purpose to solidify and dry (105). The solidified and dried composite material 1 is cut up (106) into pieces of desired shape that are used as agent 10 having fire-extinguishing properties. For agent 10 to be affixed to the surface of objects to be protected, one side of the agent is coated (107) with an adhesive layer 6 that is covered (108) with an easily detachable protective film 7.

Figure 5:
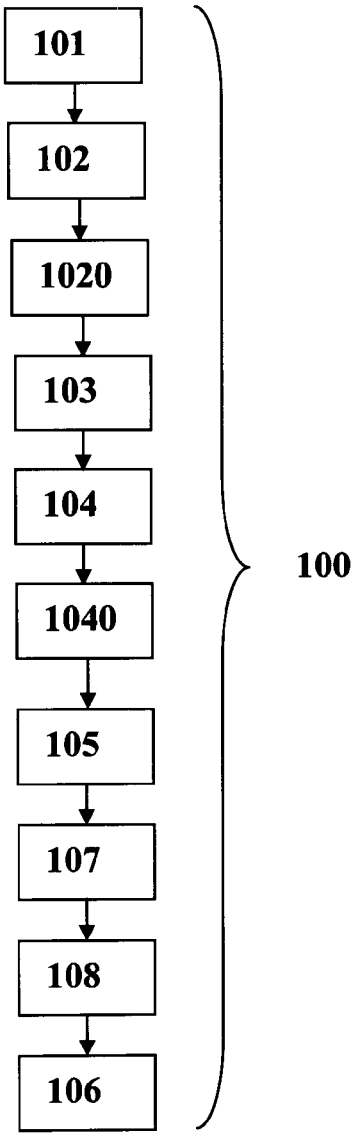
FIG. 5 is a diagrammatic view of an exemplary sequence of steps of the method for manufacturing an autonomous firefighting agent of the present invention.

FIG. 5 shows diagrammatically an example of a possible sequence of aforesaid steps of the method for manufacturing (100) an autonomous firefighting agent according to the invention by:

preparing (101) a first mixture of a fire-extinguishing agent and polyisocyanate;

obtaining (102) an emulsion of the first mixture in an aqueous solution of polyvinyl alcohol;

adding (1020) the resulting emulsion to an aqueous solution of polyethylene polyamine;

obtaining (103) a suspension of microcapsules in water;

preparing (104) a second mixture of the suspension and a binder;

shaping (1040) the second mixture into plates of desired thickness;

drying (105) the plates;

applying (107) an adhesive layer 6 to one side of a plate;

covering (108) the adhesive layer with a detachable protective film 7; and cutting up (106) the plates into pieces of desired size.

Figure 3:
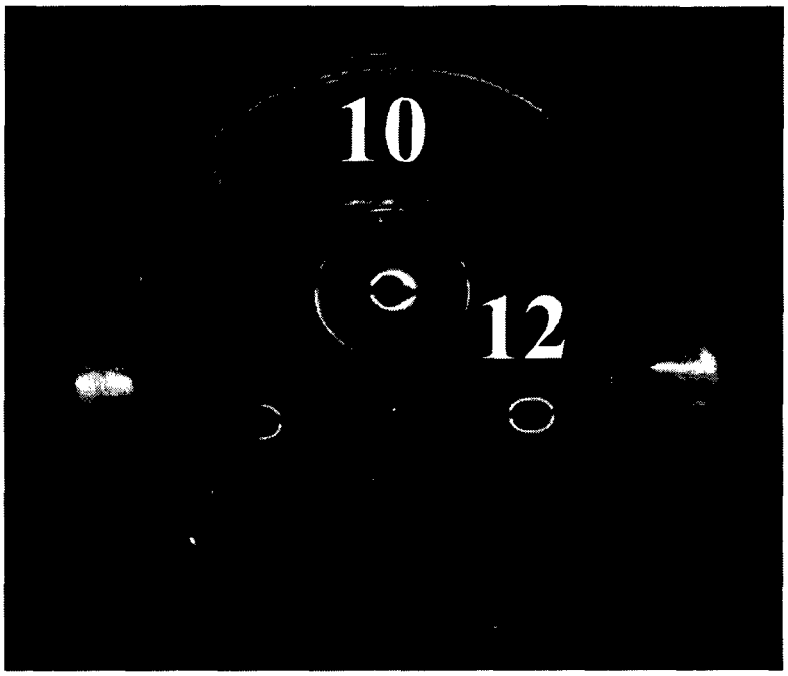
FIG. 3 is a view of a specific example of the claimed agent placed on an object to be protected, in particular the agent placed in an electrical socket box.
Figure 4:
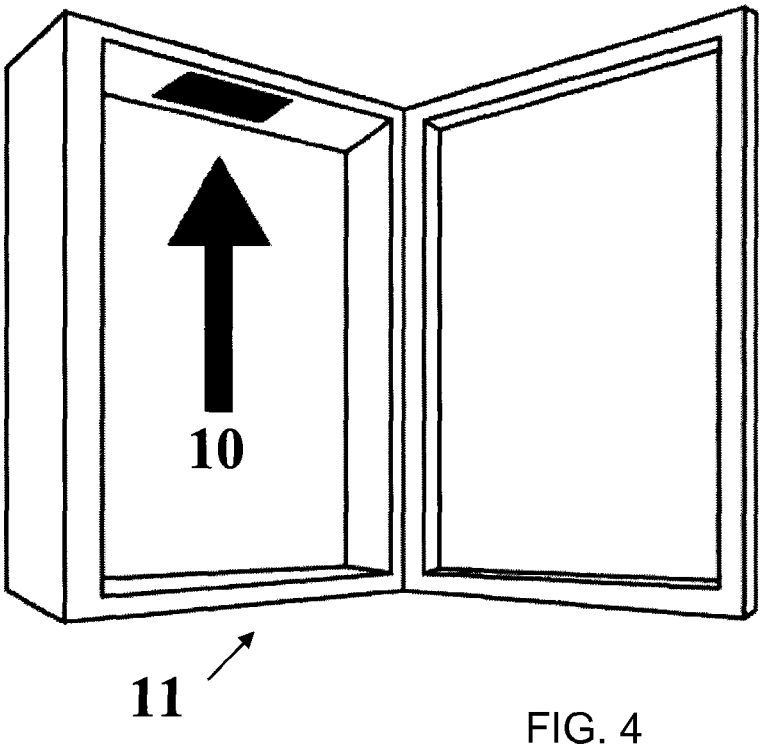
FIG. 4 is a diagrammatic view of the application of the agent in an electrical switchboard.

According to its third embodiment, the invention relates to an object 11 and 12 using autonomous firefighting agent 10 of the invention to put out fire within 10 to 20 seconds after ignition. In use, autonomous firefighting agent 10 is placed at a potentially fire-hazardous point and puts out the fire upon ignition at an early stage thereof. Fire is extinguished by halocarbon vapors released profusely when the agent is heated to a temperature above 110° C. as the microcapsule shells are broken up. Fire is put out within 10 to 20 seconds after ignition, preventing the objects protected from being destroyed. The agent is effective in protecting electrical switchboards 11 (FIG. 4) and boxes (FIG. 3), vehicle engine bays, transformer and server stations, and other electrical switchgear and power units from fire.

The invention of this patent application produces a highly efficacious firefighting agent 10 that releases intensively a fire-extinguishing agent and is flexible, strong, durable, reliable, and easy to use.

While specific embodiments of the invention have been shown and described in detail to illustrate the application of the principles of the invention, it will be understood that the invention may be embodied otherwise without departing from such principles.

What is claimed is:

1. An autonomous firefighting agent for fire extinguishing, the autonomous firefighting agent comprising:

a composite material, said composite material having fire extinguishing properties, the composite material comprising microcapsules, the microcapsules having a size from 2 to 95 μm and containing a halocarbon fire extinguishing agent surrounded by a polymer shell composed of polyurea and/or polyurethane based on a polyisocyanate prepolymer, said microcapsules being dispersed in a binding composition comprising a polymer component as a polymer base and mineral fillers in a form of mineral fibers and/or particles, wherein the composite material is in the shape of a plate, said composite material comprising a glue layer applied onto one side of said plate and coated with a detachable protective film.

2. An autonomous firefighting agent of claim 1, wherein the halocarbon comprises one of the following first substances: 1,1,2,2-tetrafluorodibromoethane; 1,1,2-trifluorotrichloroethane; and 2-iodo-1,1,1,2,3,3,3-heptafluoropropane, and/or a mixture thereof with other halocarbons.

3. An autonomous firefighting agent of claim 2, wherein the other halocarbons in the mixture comprises one of the following second substances: 1,1,2,2-tetrafluoroethane; 1,1-difluoro-2,2,2-trichloroethane; 1,2-difluorotrichloroethane; 1,1-difluoro-1,2-dichloroethane; 1,2-difluoro-1,1-dichloroethane; 1,1-difluoro-1-chloroethane; 1-fluoro-1,1-dichloroethane; 1-fluoro-2-chloroethane; pentafluorochloroethane; 1,1,2,2-tetrafluorodichloroethane; 1,1,1-trifluorotrichloroethane; 1,1,2-trifluorotrichloroethane; 1,1-difluorotetrachloroethane; and 1,2-difluorotetrachloroethane.

4. An autonomous firefighting agent of claim 1, wherein the mineral fibers contain at least one of the following materials: glass fibers; basalt fibers; fibers of natural minerals; and fibers of synthetic minerals.

5. An autonomous firefighting agent of claim 1, wherein mineral particles contain at least one of the following materials: calcite; marble; chalk; natural minerals; and synthetic minerals.

6. An autonomous firefighting agent of claim 1, wherein the polymer base comprises at least one of the following substances: acrylic resin; alkyd resin; glyptal resin; latex resin; pentaphthalic resin; epoxide resin; polyurethane; polyurea; polyvinyl alcohol; and polyvinyl acetate.

7. An autonomous firefighting agent of claim 1, wherein the composite material is provided in at least one of an electrical switchboard, an electrical box, an engine compartment of a vehicle, a transformer station, a server station, an electrical switch gear and a power unit.

8. An autonomous firefighting agent for fire extinguishing, the autonomous firefighting agent comprising:

a composite material, said composite material having fire extinguishing properties, said composite material comprising microcapsules, said microcapsules having a size from 2 to 95 μm, said microcapsules comprising a halocarbon fire extinguishing agent and a polymer shell composed of polyurea and/or polyurethane based on a polyisocyanate prepolymer, said polymer shell surrounding said halocarbon fire extinguishing agent, said microcapsules being dispersed in a binding composition comprising a polymer component as a polymer base and mineral fillers in a form of mineral fibers and/or particles, wherein said composite material is plate-shaped, said composite material comprising a glue layer applied onto one side of said plate and coated with a detachable protective film, the composite material being configured to extinguish a fire upon the composite material reaching a predetermined temperature.

9. An autonomous firefighting agent of claim 8, wherein the halocarbon comprises one of the following first substances: 1,1,2,2-tetrafluorodibromoethane; 1,1,2-trifluorotrichloroethane; and 2-iodo-1,1,1,2,3,3,3-heptafluoropropane, and/or a mixture thereof with other halocarbons.

10. An autonomous firefighting agent of claim 9, wherein the other halocarbons in the mixture comprises one of the following second substances: 1,1,2,2-tetrafluoroethane; 1,1-difluoro-2,2,2-trichloroethane; 1,2-difluorotrichloroethane; 1,1-difluoro-1,2-dichloroethane; 1,2-difluoro-1,1-dichloroethane; 1,1-difluoro-1-chloroethane; 1-fluoro-1,1-dichloroethane; 1-fluoro-2-chloroethane; pentafluorochloroethane; 1,1,2,2-tetrafluorodichloroethane; 1,1,1-trifluorotrichloroethane; 1,1,2-trifluorotrichloroethane; 1,1-difluorotetrachloroethane; and 1,2-difluorotetrachloroethane.

11. An autonomous firefighting agent of claim 8, wherein the mineral fibers contain at least one of the following materials: glass fiber; basalt fiber; fibers of natural minerals; and fibers of synthetic minerals.

12. An autonomous firefighting agent of claim 8, wherein mineral particles contain at least one of the following materials: calcite; marble; chalk; natural minerals; and synthetic minerals.

13. An autonomous firefighting agent of claim 8, wherein the polymer base comprises at least one of the following substances: acrylic resin; alkyd resin; glyptal resin; pentaphthalic resin; epoxide resin; polyurethane; polyurea; polyvinyl alcohol; and polyvinyl acetate.

14. An autonomous firefighting agent of claim 8, wherein the composite material is provided in at least one of a an electrical switchboard, an electrical box, an engine compartment of a vehicle, a transformer station, a server station, an electrical switch gear and a power unit.

15. An object, comprising:

an autonomous firefighting agent for putting out fire, said autonomous firefighting agent comprising a composite material, said composite material comprising microcapsules with a size from 2 to 95 μm, said microcapsules containing a halocarbon fire extinguishing agent surrounded by a polymer shell composed of polyurea and/or polyurethane based on a polyisocyanate prepolymer, said microcapsules being dispersed in a binding composition comprising a polymer component as a polymer base and mineral fillers in a form of mineral fibers and/or particles, wherein the composite material is plate shaped, said composite material comprising a glue layer applied onto one side of said plate and coated with a detachable protective film.

16. An object in accordance with claim 15, wherein the composite material is provided in at least one of an electrical switchboard, an electrical box, an engine compartment of a vehicle, a transformer station, a server station, an electrical switch gear and a power unit.

* * * * *